US011837423B2

(12) United States Patent
Neelakantan

(10) Patent No.: US 11,837,423 B2
(45) Date of Patent: Dec. 5, 2023

(54) ARRANGEMENT AND MODULE FOR ELECTRICAL CONTACTOR ASSEMBLIES

(71) Applicant: GM GLOBAL TECHNOLOGY OPERATIONS LLC, Detroit, MI (US)

(72) Inventor: Vijay A. Neelakantan, Rochester Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 169 days.

(21) Appl. No.: 17/493,879

(22) Filed: Oct. 5, 2021

(65) Prior Publication Data

US 2023/0105506 A1 Apr. 6, 2023

(51) Int. Cl.

| | |
|---|---|
| ***H01H 9/00*** | (2006.01) |
| ***H01H 50/04*** | (2006.01) |
| *H01H 51/29* | (2006.01) |
| *H01H 50/20* | (2006.01) |
| *H01H 50/54* | (2006.01) |

(52) U.S. Cl.

CPC ..... *H01H 50/04* (2013.01); *H01H 50/20* (2013.01); *H01H 50/546* (2013.01); *H01H 51/29* (2013.01); *H01H 2050/049* (2013.01)

(58) Field of Classification Search

CPC ..... H01H 50/04; H01H 50/20; H01H 50/546; H01H 51/29; H01H 2050/049; H01H 50/30

USPC ..... 335/162

See application file for complete search history.

(56) References Cited

U.S. PATENT DOCUMENTS

| | | | | |
|---|---|---|---|---|
| 3,004,121 | A * | 10/1961 | Purdy | H01H 50/546 335/196 |
| 2011/0100144 | A1* | 5/2011 | Neelakantan | F16H 63/18 74/473.36 |
| 2011/0107864 | A1* | 5/2011 | Bai | F16H 61/28 74/473.12 |
| 2011/0195794 | A1* | 8/2011 | Bai | F16D 3/12 464/66.1 |
| 2012/0251359 | A1* | 10/2012 | Neelakantan | F04B 11/0058 417/416 |
| 2018/0023635 | A1* | 1/2018 | Neelakantan | F16D 25/061 475/149 |

* cited by examiner

*Primary Examiner* — Shawki S Ismail
*Assistant Examiner* — Lisa N Homza
(74) *Attorney, Agent, or Firm* — Quinn IP Law

(57) ABSTRACT

An electrical contactor module includes a pair of contactor assemblies each having an input contact, an output contact spaced apart from the input contact, and a linear solenoid disposed proximate the input and output contacts. Each linear solenoid has a housing, a plunger disposed within the housing so as to permit axial displacement of the plunger between an open position in which an end of the plunger is spaced apart from the input and output contacts and a closed position in which the end mechanically contacts and electrically couples the input and output contacts, a spring for biasing the plunger in the open position, and a coil within the housing for urging the plunger from the open position to the closed position along a linear direction. The contactor assemblies are fastened and arranged within an enclosure, with the linear directions for the contactor assemblies pointing in generally opposite directions.

20 Claims, 6 Drawing Sheets

ARRANGEMENT AND MODULE FOR ELECTRICAL CONTACTOR ASSEMBLIES

INTRODUCTION

This disclosure relates generally to arrangements and modules for electrical contactor assemblies.

In many high-voltage applications, it is common practice to include a module or control box to control the opening and closing of one or more high-voltage power lines. For example, in high-voltage battery applications, the module or control box may selectably open and close the positive and negative power lines. This opening and closing of the power lines may be effected by solenoids assigned to each power line. Each solenoid may be selectably energized by sending a low-voltage control signal to the solenoid, and de-energized by turning off the control signal. The contacts for each high-voltage line within the module or control box may be arranged to be normally-open in order to interrupt or prevent any flow of high voltage across the contacts. When it is desired to provide high-voltage flow across the contacts, the solenoids may be energized so as to close or bridge the normally-open contacts.

One potential concern with this arrangement is when a sudden mechanical impulse is exerted on the module or control box. This may cause the contacts to abruptly open if they were previously closed (thereby interrupting the flow of power), or close if they were previously open (thereby turning on the flow of power).

SUMMARY

According to one embodiment, an arrangement of electrical contactor assemblies includes first and second electrical contactor assemblies and an enclosure. The first contactor assembly has a first input contact, a first output contact spaced a first width from the first input contact, and a first linear solenoid disposed proximate the first input and output contacts. The first linear solenoid has a first housing, a first plunger disposed within the first housing so as to permit axial displacement of the first plunger between a first open position, in which a first end of the first plunger is spaced apart from the first input and output contacts, and a first closed position, in which the first end mechanically contacts and electrically couples the first input and output contacts. The first linear solenoid also includes a first spring configured for biasing the first plunger in the first open position, and a first coil disposed within the first housing and configured for urging the first plunger from the first open position to the first closed position along a first linear direction.

The second contactor assembly has a second input contact, a second output contact spaced a second width from the second input contact, and a second linear solenoid disposed proximate the second input and output contacts. The second linear solenoid has a second housing, a second plunger disposed within the second housing so as to permit axial displacement of the second plunger between a second open position, in which a second end of the second plunger is spaced apart from the second input and output contacts, and a second closed position, in which the second end mechanically contacts and electrically couples the second input and output contacts. The second linear solenoid also includes a second spring configured for biasing the second plunger in the second open position, and a second coil disposed within the second housing and configured for urging the second plunger from the second open position to the second closed position along a second linear direction that is generally opposite the first linear direction. The first and second contactor assemblies are fastened and arranged within the enclosure.

The first coil may be further configured for selectably overcoming a first bias force exerted by the first spring, and the second coil may be further configured for selectably overcoming a second bias force exerted by the second spring. In this configuration, the first coil may be configured for selectably overcoming the first bias force by a first electrical activation being applied to the first coil, and the second coil may be configured for selectably overcoming the second bias force by a second electrical activation being applied to the second coil.

The first and second ends of the first and second plungers, respectively, may be electrically conductive. Additionally, the first input and output contacts may be separated by a first gap, and the second input and output contacts may be separated by a second gap.

In a commanded-OFF state, the first and second ends may be disposed in the first and second open positions, respectively, and in a commanded-ON state, the first and second ends may be disposed in the first and second closed positions, respectively. In this configuration, the first and second contactor assemblies may be arranged such that if the enclosure is subjected to a mechanical impulse in the commanded-ON or commanded-OFF state, only one of the first and second ends is perturbable by the mechanical impulse from its respective open or closed position.

The first contactor assembly may be configured for a positive polarity electrical flow, and the second contactor assembly may be configured for a negative polarity electrical flow. Additionally, the first end may extend outside the first housing in the first open position, and the second end may extend outside the second housing in the second open position. Furthermore, each of the first and second contactor assemblies may be configured for passing at least 100 volts through its respective input contact, end, and output contact.

According to another embodiment, an electrical contactor module includes a pair of contactor assemblies each having a respective input contact, a respective output contact separated by a respective gap from the respective input contact, and a respective linear solenoid disposed proximate the respective input and output contacts. Each respective linear solenoid has a respective housing, a respective plunger disposed within the respective housing so as to permit axial displacement of the respective plunger between a respective open position (in which a respective end of the respective plunger is spaced apart from the respective input and output contacts) and a respective closed position (in which the respective end mechanically contacts and electrically couples the respective input and output contacts), a respective spring configured for biasing the respective plunger in the respective open position, and a respective coil disposed within the respective housing and configured for urging the respective plunger from the respective open position to the respective closed position along a respective linear direction. The electrical contactor module further includes an enclosure in which the contactor assemblies are fastened and arranged, such that the linear directions for the pair of contactor assemblies point in generally opposite directions from each other.

Each respective coil may be further configured for selectably overcoming a respective bias force exerted by the respective spring by a respective electrical activation being applied to the respective coil. In a commanded-OFF state, the ends of the plungers may be disposed in their respective open positions, and in a commanded-ON state, the ends of the plungers may be disposed in their respective closed positions. In this configuration, the contactor assemblies may be arranged such that if the enclosure is subjected to a mechanical impulse in the commanded-ON or commanded-OFF state, only one of the ends of the plungers is perturbable by the mechanical impulse from its respective open or closed position. One of the pair of contactor assemblies may be configured for a positive polarity electrical flow, and the other of the pair of contactor assemblies may be configured for a negative polarity electrical flow, wherein each of the contactor assemblies may be configured for passing at least 100 volts through its respective input contact, end of plunger and output contact.

According to yet another embodiment, a module for mounting high-voltage contactors includes: (i) a pair of contactor assemblies each having a respective input contact, a respective output contact separated by a respective gap from the respective input contact, and a respective linear solenoid disposed proximate the respective input and output contacts, each respective linear solenoid having a respective housing, a respective plunger disposed within the respective housing so as to permit axial displacement of the respective plunger between a respective open position in which a respective end of the respective plunger is spaced apart from the respective input and output contacts and a respective closed position in which the respective end mechanically contacts and electrically couples the respective input and output contacts, a respective spring configured for biasing the respective plunger in the respective open position, and a respective coil disposed within the respective housing and configured for urging the respective plunger from the respective open position to the respective closed position along a respective linear direction; and (ii) an enclosure in which the contactor assemblies are arranged and fastened, such that the linear directions for the pair of contactor assemblies point in opposite directions from each other; (iii) wherein in a commanded-OFF state, the ends of the plungers are disposed in their respective open positions, and in a commanded-ON state, the ends of the plungers are disposed in their respective closed positions, the first and second contactor assemblies being arranged such that if a mechanical impulse is imparted onto the enclosure in the commanded-ON or commanded-OFF state, only one of the first and second ends is perturbable by the mechanical impulse from its respective open or closed position.

Each respective coil may be further configured for selectably overcoming a respective bias force exerted by the respective spring by a respective electrical activation being applied to the respective coil. Additionally, each respective end may extend outside its respective housing in the commanded-OFF state. A first one of the pair of contactor assemblies may be configured for a positive polarity electrical flow, and a second one of the pair of contactor assemblies may be configured for a negative polarity electrical flow. Moreover, each of the contactor assemblies may be configured for passing at least 100 volts through its respective input contact, end of plunger and output contact.

The above features and advantages, and other features and advantages, of the present teachings are readily apparent from the following detailed description of some of the best modes and other embodiments for carrying out the present teachings, as defined in the appended claims, when taken in connection with the accompanying drawings.

DETAILED DESCRIPTION

Figure 1:
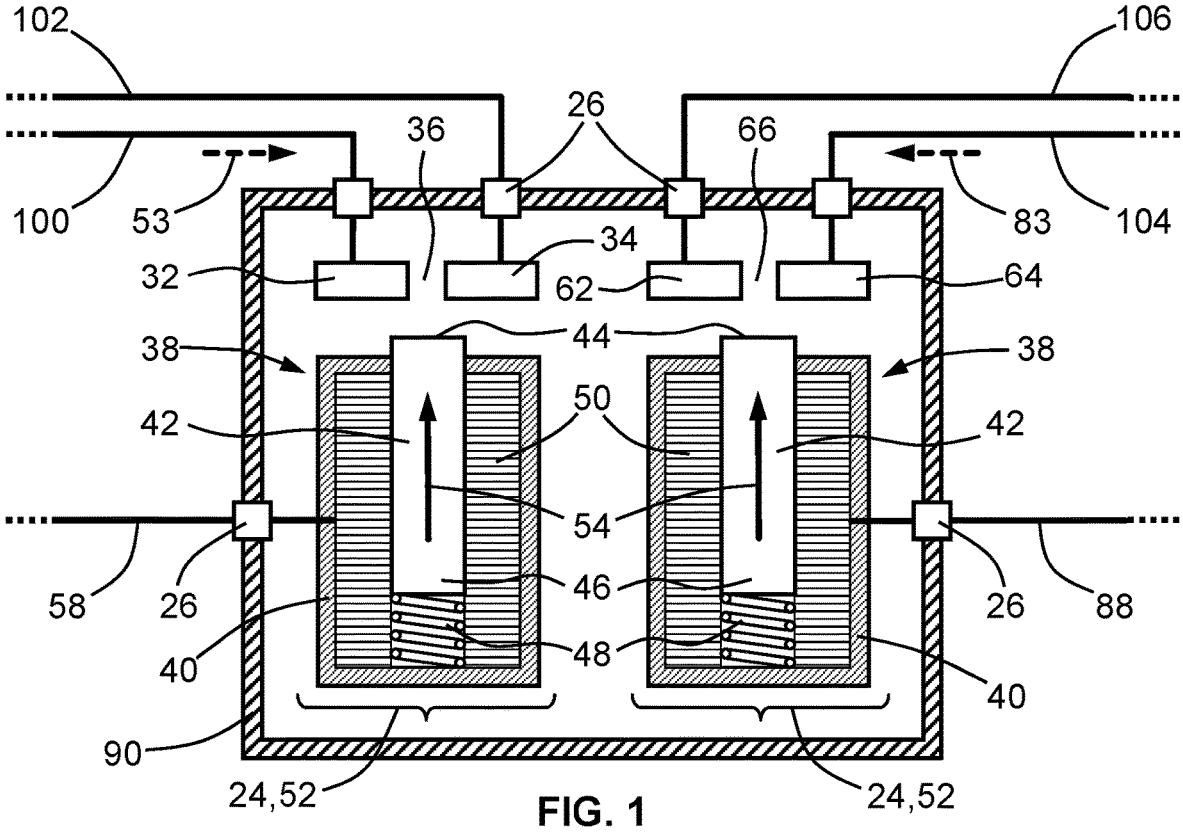
FIGS. 1-2 are schematic cross-sectional views of a customary electrical contactor module in a commanded-OFF state and a commanded-ON state, respectively.

Referring now to the drawings, wherein like numerals indicate like parts in the several views, an arrangement 20 of electrical contactor assemblies 24, an electrical contactor module 22, and a module 22 for mounting high-voltage contactors 24 are shown and described herein.

Figure 2:
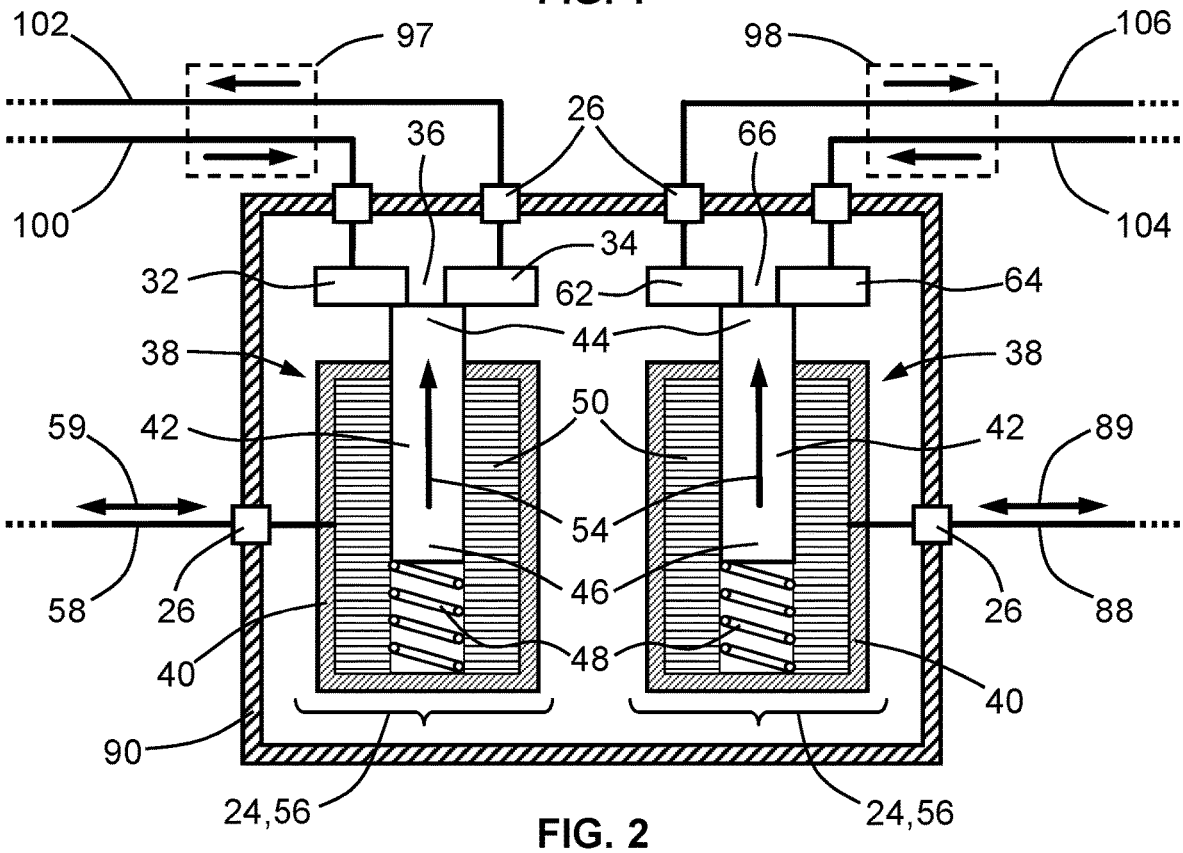

FIG. 1 shows a schematic cross-sectional view of a customary electrical contactor module in a commanded-OFF state, and FIG. 2 shows the same electrical contactor module in a commanded-ON state. The module includes two identical contactor assemblies 24 housed within an enclosure 90. The contactor assembly 24 shown on the left of the drawings has a first input contact 32, a first output contact 34 separated from the first input contact 32 by a first gap 36, and a linear solenoid 38 disposed near the first input and output contacts 32, 34. The contactor assembly 24 on the right side of the drawings is very similar—and in fact, has the same solenoid 38 and orientation of the solenoid 38 as the contactor assembly 24 shown on the left of the drawings—with the only difference being the reference numerals and nomenclature used for the input and output contactors and related wiring. The contactor assembly 24 shown on the right of the drawings has a second input contact 62, a second output contact 64 separated from the second input contact 62 by a second gap 66, and a linear solenoid 38 disposed near the second input and output contacts 62, 64.

Each of the two linear solenoids 38 has a respective housing 40 and a respective plunger 42 disposed within the housing 40, arranged so as to permit axial or translational displacement of each plunger 42 between an open position 52 (FIG. 1) and a closed position 56 (FIG. 2). In the open position 52, an end 44 of each plunger 42 is spaced apart from its respective input and output contacts 32, 34, 62, 64 and both circuits are open. (Each plunger 42 also has an opposing end 46 opposite the contact-closing end 42.) In the closed position 56, each plunger end 44 mechanically contacts and electrically couples its respective input and output contacts 32, 34, 62, 64 and each of the two circuits is closed.

In the closed position 56 (FIG. 2), a first electrical flow 97 (e.g., positive polarity flow) passes through the first power line input 100 and the first power line output 102 (as represented by the two solid arrows in the box indicated by reference numeral 97), and a second electrical flow 98 (e.g., negative polarity or ground flow) passes through the second power line input 104 and the second power line output 106 (as represented by the two solid arrows in the box indicated by reference numeral 98). In the open position 52 (FIG. 1), first and second potential electrical flows 53, 83 are indicated by the dashed arrows; these are referred to as only "potential" electrical flows because the first input and output contacts 32, 34 are open and the second input and output contacts are open, thus no electrical flow is enabled therethrough. (Note that grommets 26 are situated in the wall of the enclosure 90 to permit various wires 58, 88 and power lines 100, 102, 104, 106 to pass through the enclosure 90.) Each linear solenoid 38 also includes a spring 48 configured for biasing the plunger 42 in the open position 52, and a coil 50 disposed within the housing 40 and configured for urging the plunger 42 from the open position 52 to the closed position 56 along a linear direction 54 which points toward the first input and output contacts 32, 34, 62, 64. Note in FIGS. 1-3, which illustrate a customary approach for packaging and arranging internal components, that the linear directions 54 (e.g., actuation directions) for the two solenoids 38 and contactor assemblies 24 both point in the same direction.

Each solenoid 38 may also include a spring 48 which exerts a bias force on the plunger 42, which biases the plunger 42 toward the open position 52. Each solenoid 38 may also include a coil 50 for selectably overcoming the spring's bias force and for urging the plunger 42 to axially or longitudinally translate toward the closed position 56. Thus, in a "commanded-ON" state (FIG. 2), an electrical activation 59, 89 may be applied to each coil 50 for urging the plungers 42 into the closed position 56, but in a "commanded-OFF" state (FIG. 1) when no electrical activation 59, 89 is applied to the coils 50, the springs 48 will keep the plungers 42 in the open position 52. In other words, when no electrical activation 59, 89 is applied to either or both coils 50, the nominal "fail safe" position would be for both plungers 42 to be biased by the springs 48 into their respective open positions 52.

Figure 3:
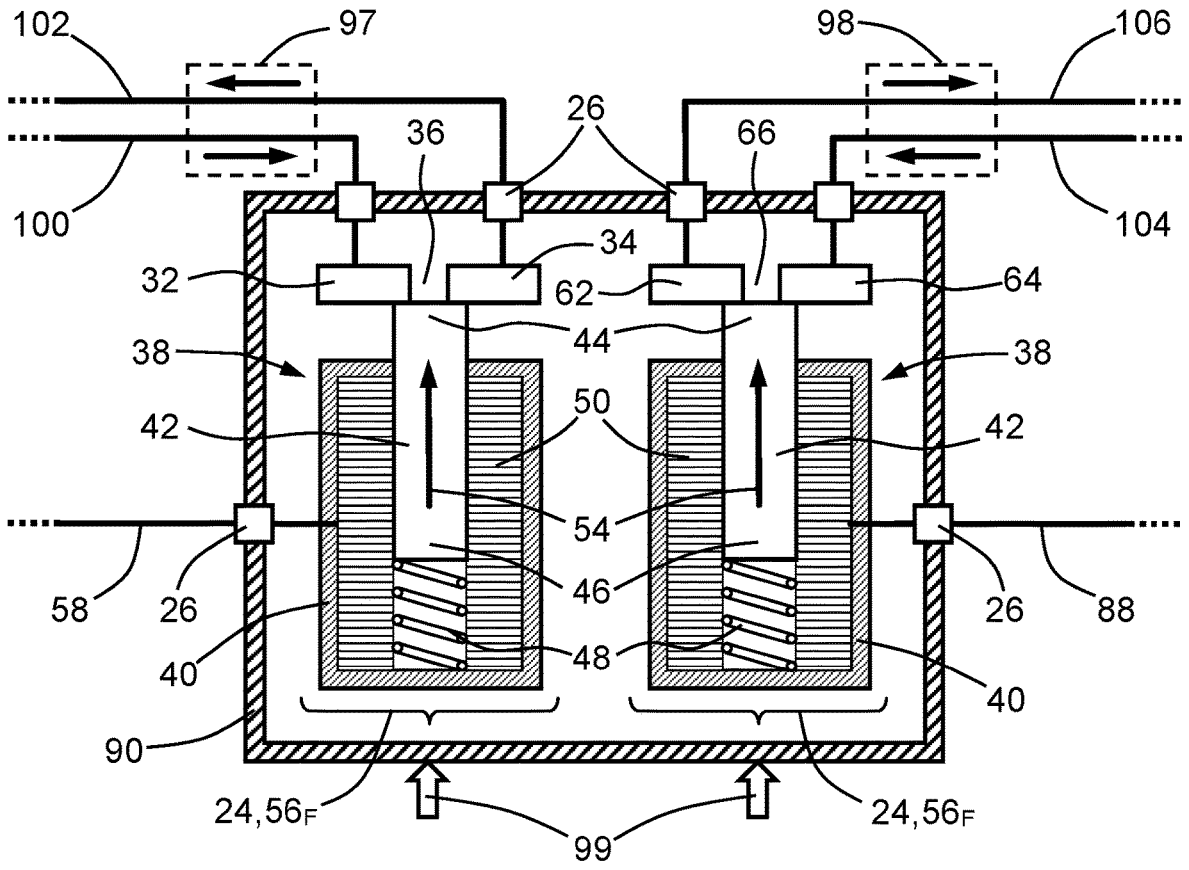
FIG. 3 is a schematic cross-sectional view of a customary electrical contactor module in a commanded-OFF state, but with an external impulse causing non-commanded contact closures.

FIG. 3 shows the contactor module of FIGS. 1-2 in the commanded-OFF state, with no electrical activation 59, 89 flowing to either of the solenoid coils 50. In this commanded-OFF state, the plungers 42 should be in the open position 52, with neither of the plungers 42 in contact with their respective contacts 32, 34, 62, 64, and no electrical flow 97, 98 should be flowing through the power lines 100, 102, 104, 106. However, a sudden mechanical impulse 99 has been exerted on the enclosure 90, causing the plungers 42 to be knocked or perturbed into a forced-closed position $\mathbf{56}_F$ with the plungers 42 forced into direct contact their respective contacts 32, 34, 62, 64. This in turn causes unexpected electrical flow 97, 98 through the power lines 100, 102, 104, 106. Even if the mechanical impulse 99 is only momentary and brief, this unexpected flow of power 97, 98 through the power lines 100, 102, 104, 106 may have undesirable consequences.

Figure 4:
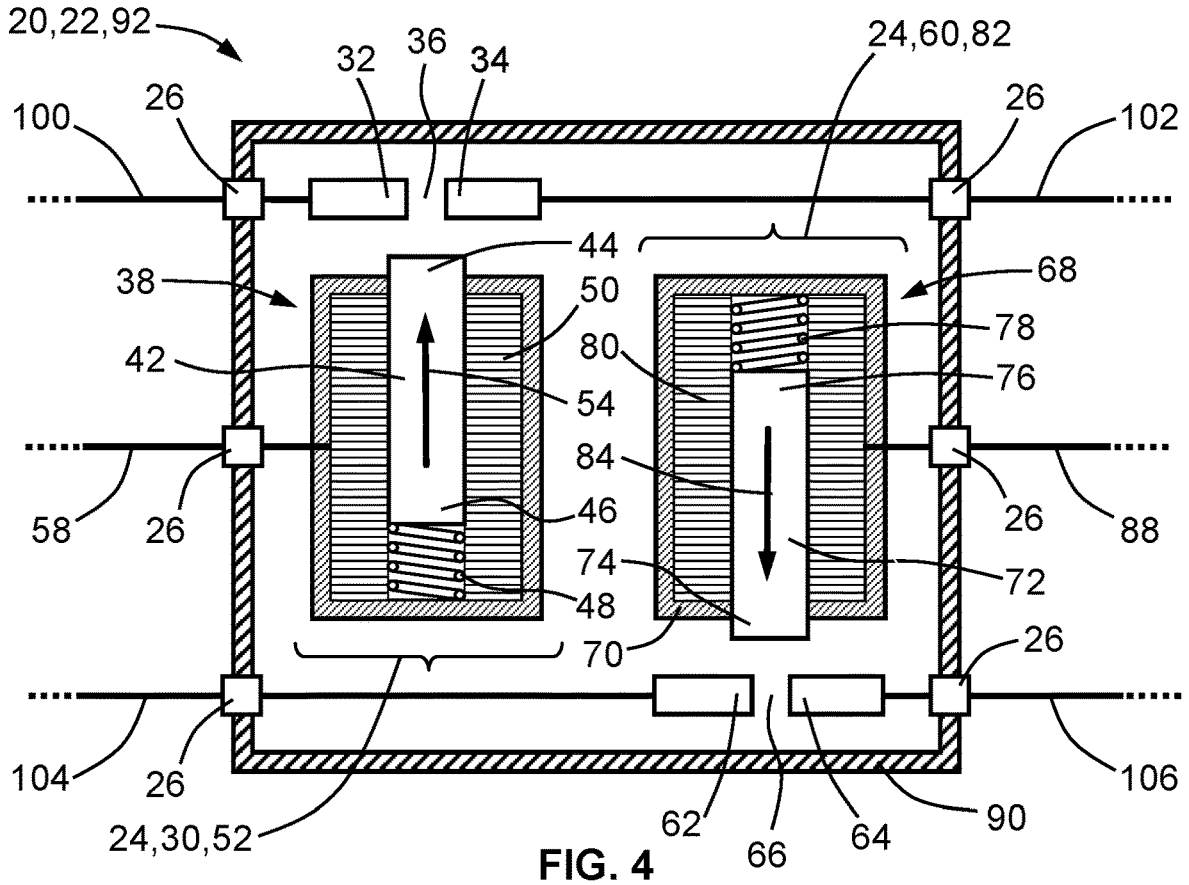
FIGS. 4-5 are schematic cross-sectional views of an electrical contactor module in accordance with the present disclosure, in commanded-OFF and commanded-ON states, respectively.
Figure 5:
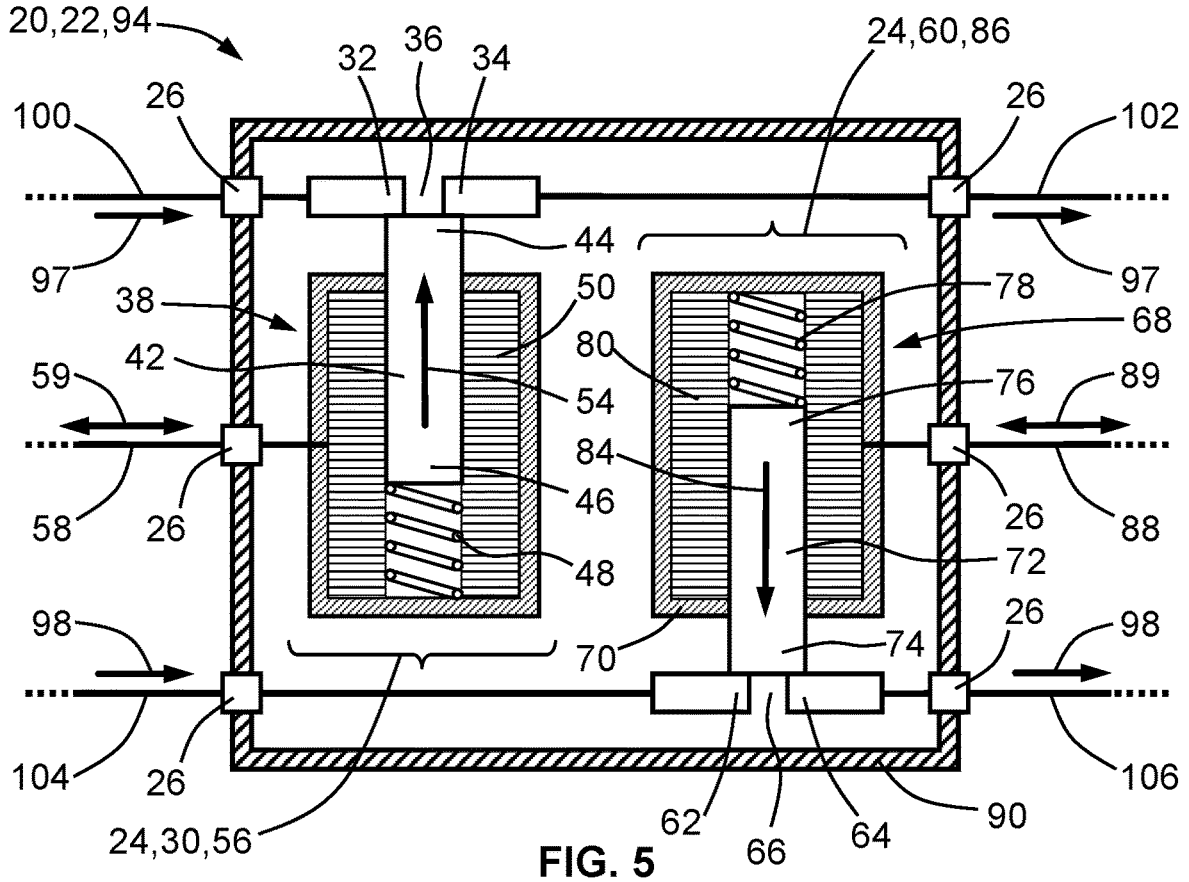
Figure 6:
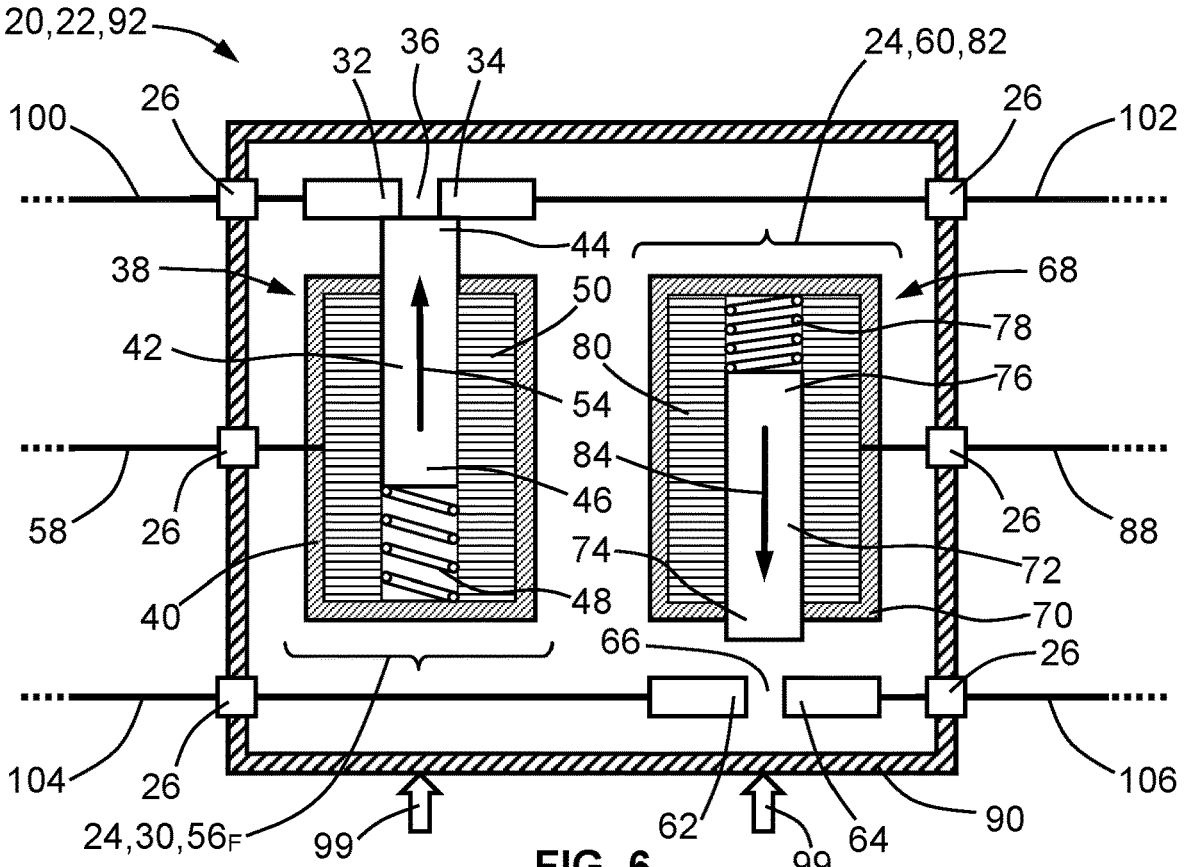
FIGS. 6-7 are schematic cross-sectional views of an electrical contactor module in accordance with the present disclosure in a commanded-OFF state, but with non-commanded contact closures caused by external mechanical impulses exerted along first and second linear directions, respectively.
Figure 7:
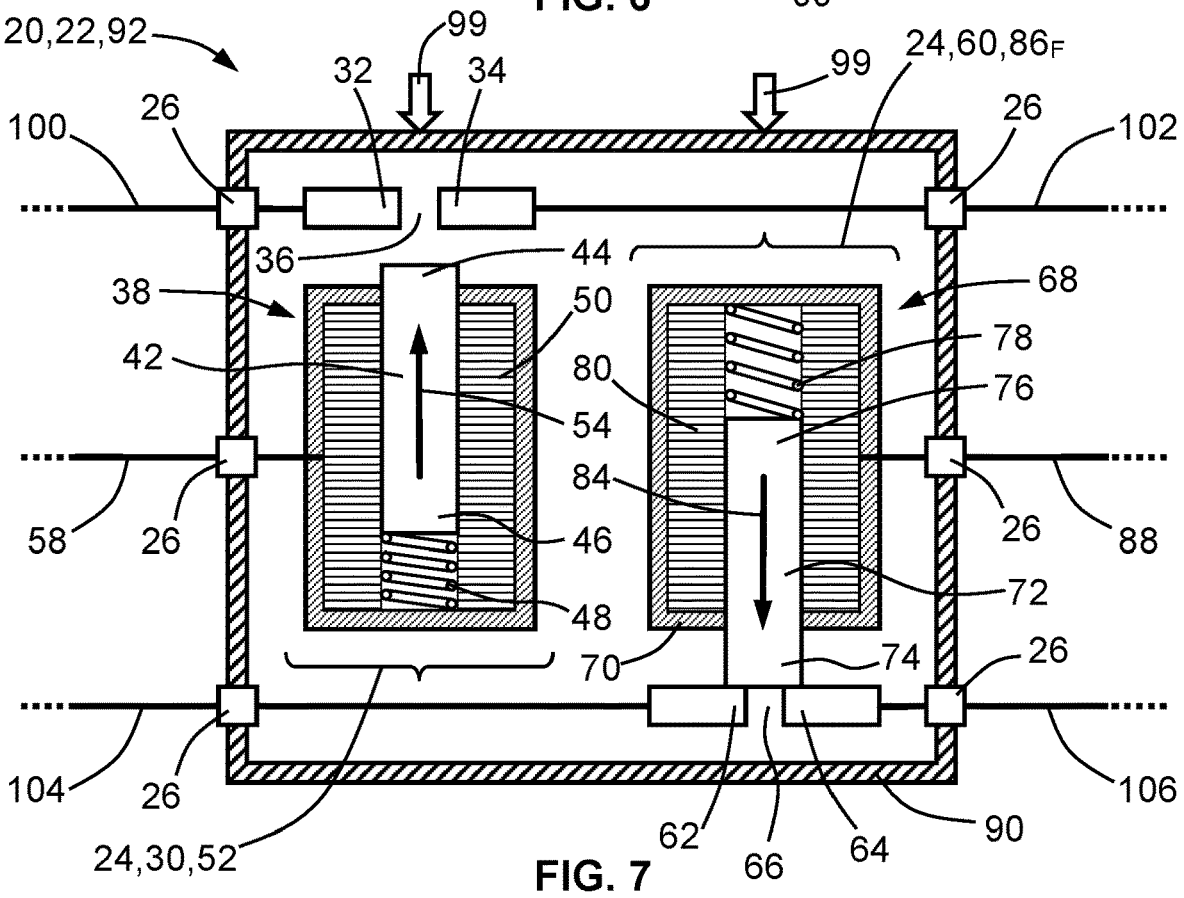
Figure 8:
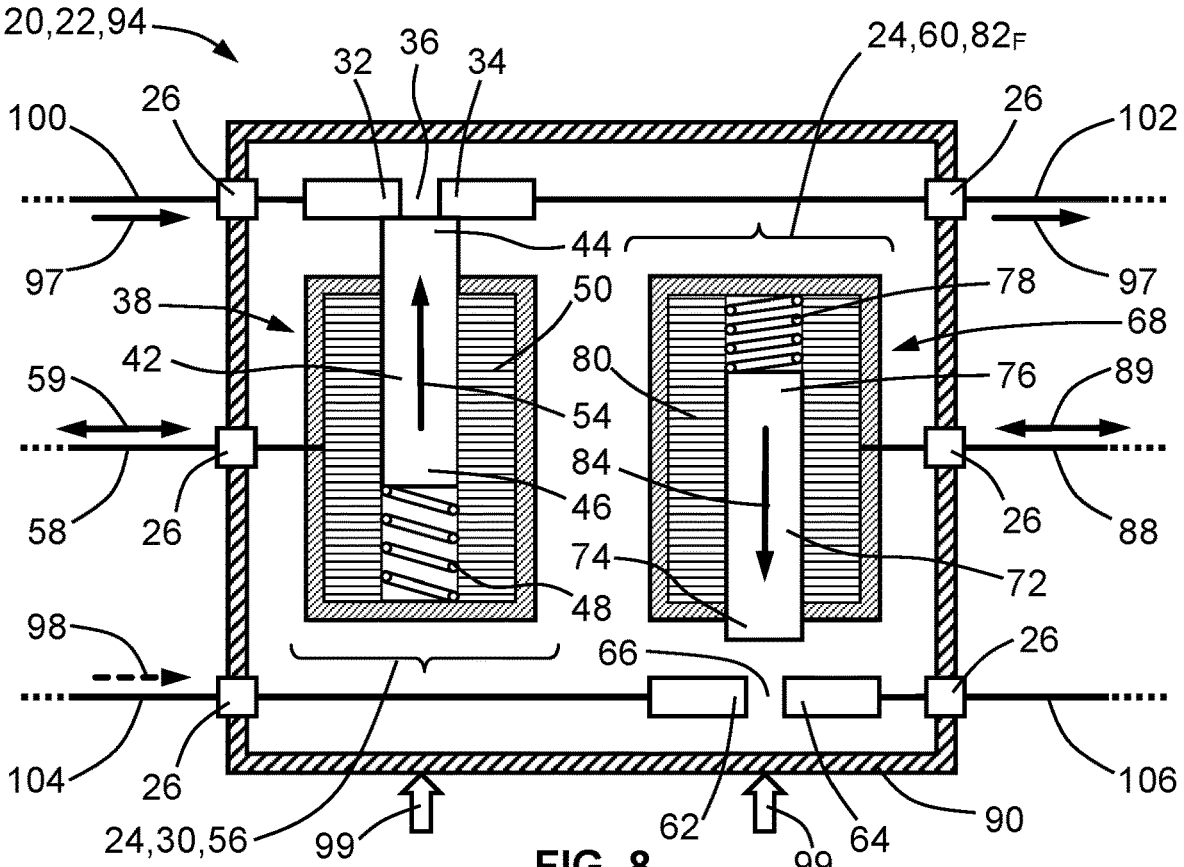
FIGS. 8-9 are schematic cross-sectional views of an electrical contactor module in accordance with the present disclosure in a commanded-ON state, but with non-commanded contact opens caused by external mechanical impulses exerted along first and second linear directions, respectively.
Figure 9:
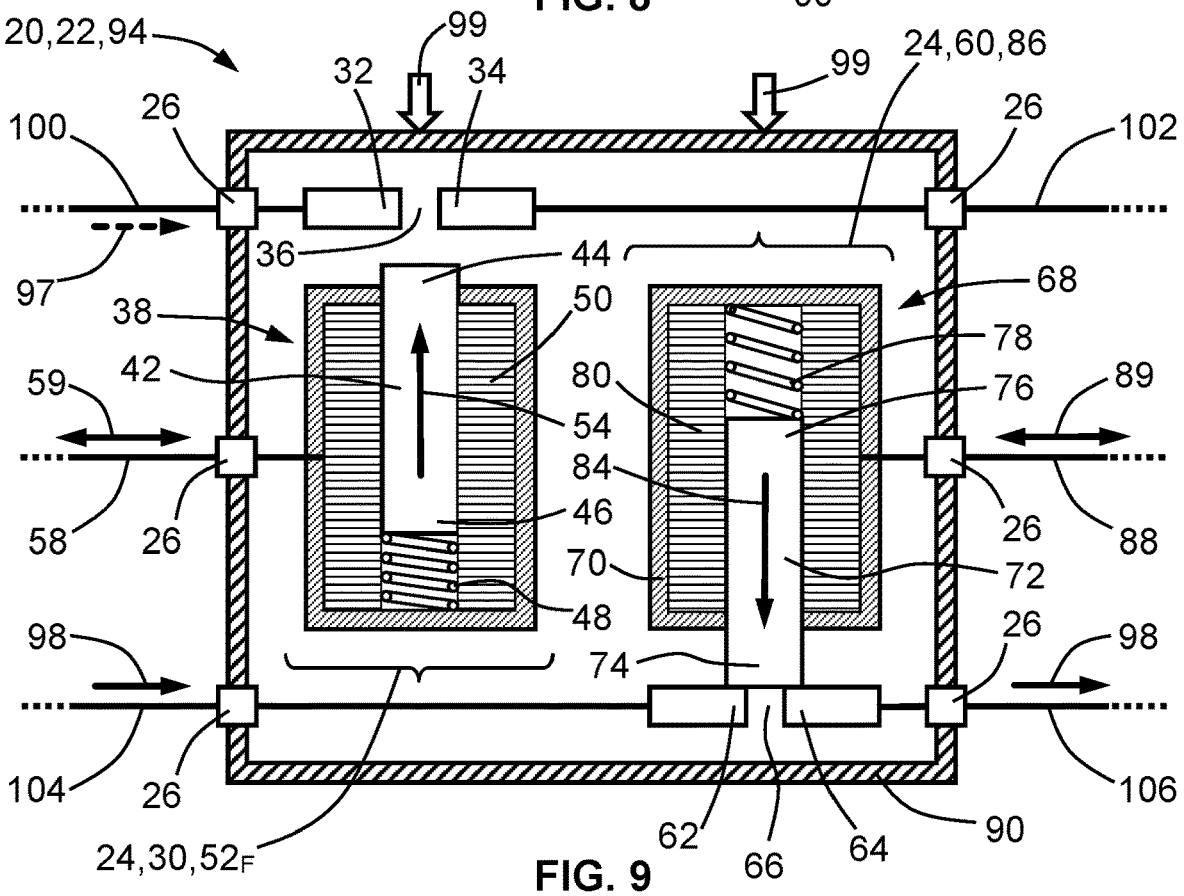

In contrast, FIGS. 4-9 show schematic cross-sectional views of an electrical contactor module 22 according to the present disclosure which avoids the aforementioned concerns. More specifically: FIGS. 4-5 show the electrical contactor module 22 in commanded-OFF and commanded-ON states 92, 94, respectively; FIGS. 6-7 show the electrical contactor module 22 in a commanded-OFF state 92 but with non-commanded contact closures (and forced-closed states $\mathbf{56}_F$, $\mathbf{86}_F$) caused by external mechanical impulses 99 exerted along first and second linear directions 54, 84, respectively; and FIGS. 8-9 show the electrical contactor module 22 in a commanded-ON state 94, but with non-commanded contact opens (and forced-open states $\mathbf{52}_F$, $\mathbf{82}_F$) caused by external mechanical impulses 99 exerted along the first and second linear directions, 54, 84, respectively.

In this embodiment, an arrangement 20 of electrical contactor assemblies 24 includes first and second electrical contactor assemblies 30, 60 housed within an enclosure 90. (Note that as used herein, reference numeral 24 refers to any and/or all electrical contactor assemblies, while reference numerals 30 and 60 refer specifically to the first and second electrical contactor assemblies, respectively.) The first contactor assembly 30 has a first input contact 32, a first output contact 34 spaced a first width $W_1$ from the first input contact 32, and a first linear solenoid 38 disposed proximate the first input and output contacts 32, 34. (That is, the first input and output contacts 32, 34 may be separated by a first gap 36, with the first width $W_1$ spanning the first gap 36.) The first linear solenoid 38 has a first housing 40, a first plunger 42 disposed within the first housing 40 so as to permit axial or longitudinal displacement of the first plunger 42 between a first open position 52, in which a first end 44 of the first plunger 42 is spaced apart from the proximity of the first input and output contacts 32, 34, and a first closed position 56, in which the first end 44 mechanically contacts and electrically couples the first input and output contacts 32, 34. The first linear solenoid 38 also includes a first spring 48 configured for biasing the first plunger 42 in the first open position 52, and a first coil 50 disposed within the first housing 40 and configured for urging the first plunger 42 from the first open position 52 to the first closed position 56 along a first linear direction 54.

Similarly, the second contactor assembly 60 has a second input contact 62, a second output contact 64 spaced a second width $W_2$ from the second input contact 62, and a second linear solenoid 68 disposed proximate the second input and output contacts 62, 64. (That is, the second input and output contacts 62, 64 may be separated by a second gap 66, with the second width $W_2$ spanning the second gap 66.) The second linear solenoid 68 has a second housing 70, a second plunger 72 disposed within the second housing 70 so as to permit axial or longitudinal displacement of the second plunger 72 between a second open position 82, in which a second end 74 of the second plunger 72 is spaced apart from the second input and output contacts 62, 64, and a second closed position 86, in which the second end 74 mechanically contacts and electrically couples the second input and output contacts 62, 64. The second linear solenoid 68 also includes a second spring 78 configured for biasing the second plunger 72 in the second open position 82, and a second coil 80 disposed within the second housing 70 and configured for urging the second plunger 72 from the second open position 82 to the second closed position 86 along a second linear direction 84 that is generally opposite the first linear direction 54.

Figure 11:
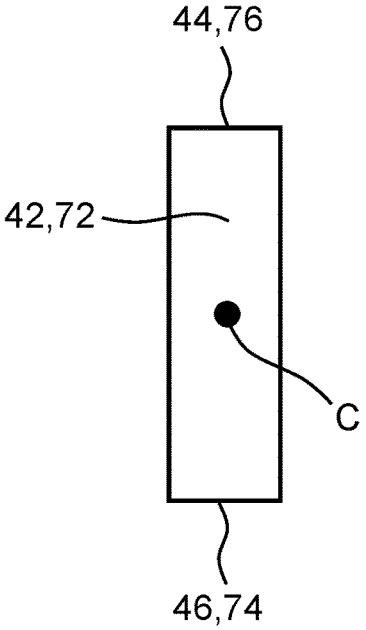
FIG. 11 is a free-body diagram of a first or second plunger in a commanded-OFF state.
Figure 12:
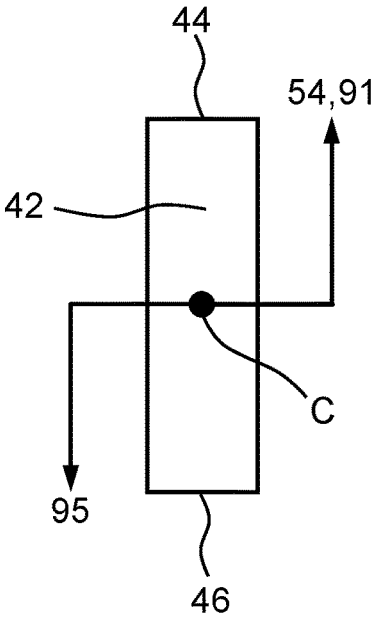
FIGS. 12-13 are free-body diagrams of first and second plungers, respectively, in a commanded-ON state.
Figure 13:
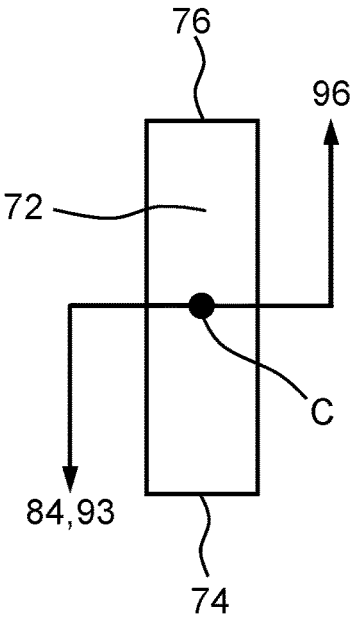

The first and second contactor assemblies 30, 60 are fastened and arranged within the enclosure 90. (I.e., the assemblies 30, 60 are fastened to the interior of the enclosure 90.) As illustrated in the free-body diagrams of FIGS. 11-13, where reference letter C represents the center of mass for each plunger 42, 72, the first coil 50 may be configured for selectably overcoming a first bias force 95 exerted by the first spring 48, and the second coil 80 may be configured for selectably overcoming a second bias force 96 exerted by the second spring 78. The first coil 50 may be configured for selectably overcoming the first bias force 95 by a first electrical activation 59 being applied to the first coil 50 via first electrical leads 58 (thereby creating a first translational force 91 acting in the first linear direction 54), and the second coil 80 may be configured for selectably overcoming the second bias force 96 by a second electrical activation 89 being applied to the second coil 80 via second electrical leads 88 (thereby creating a second translational force 93 acting in the second linear direction 84).

The first and second ends 44, 74 of the first and second plungers 42, 72, respectively, may be electrically conductive (e.g., made of or coated with metal or an electrically conductive material). Alternatively, each entire plunger 42, 72 may be electrically conductive (i.e., from the first end 44 to the opposing third end 46 of the first plunger 42, and from the second end 74 to the opposing fourth end 76 of the second plunger 72).

In a commanded-OFF state 92 (e.g., FIG. 4), the first and second ends 44, 74 may be disposed in the first and second open positions 52, 82, respectively, and in a commanded-ON state 94 (e.g., FIG. 5), the first and second ends 44, 74 may be disposed in the first and second closed positions 56, 86, respectively. In this configuration, the first and second contactor assemblies 30, 60 may be arranged such that if the enclosure 90 is subjected to a mechanical impulse 99 in the commanded-ON state 94 (FIGS. 8-9) or in the commanded-OFF state 92 (FIGS. 6-7), only one of the first and second ends 44, 74 is perturbable by the mechanical impulse 99 from its respective commanded open position 52, 82 or commanded closed position 56, 86. This may be accomplished by arranging the contactor assemblies 30, 60 such that their respective first and second actuation directions 54, 84 point in generally opposite directions from each other.

For example, in FIGS. 6-7 where the module 22 is in a commanded-OFF state 92, one or more external mechanical impulses 99 may act upon the enclosure 90 so as to cause the first plunger 42 to be perturbed or forced into a first forced-closed state $\mathbf{56}_F$ (FIG. 6) or so as to cause the second plunger 72 to be perturbed or forced into a second forced-closed state $\mathbf{86}_F$ (FIG. 7). Similarly, in FIGS. 8-9 where the module 22 is in a commanded-ON state 94, one or more external mechanical impulses 99 may act upon the enclosure 90 so as to cause the first plunger 42 to be perturbed or forced into a first forced-open state $\mathbf{52}_F$ (FIG. 8) or so as to cause the second plunger 72 to be perturbed or forced into a second forced-open state $\mathbf{82}_F$ (FIG. 9). By arranging the contactor assemblies 24 (i.e., the first and second contactor assemblies 30, 60) such that their respective first and second actuation directions 54, 84 are pointed in generally opposite directions from each other, only one—but not both—of the contactor assemblies 30, 60 may be forced from its commanded-OFF or commanded-ON state 92, 94, thereby preventing unexpected electrical flow from both of the contactor assemblies 30, 60 at the same time.

The first contactor assembly 30 may be configured for a first polarity electrical flow 97, and the second contactor assembly 60 may be configured for a second polarity electrical flow 98. For example, the first polarity electrical flow 97 may be a positive polarity electrical flow, and the second polarity electrical flow 98 may be a negative polarity or ground electrical flow. Additionally, the first end 44 may extend outside the first housing 40 in the first open position 52, and the second end 74 may extend outside the second housing 70 in the second open position 82. (Alternatively, the first end 44 may be disposed inside or within the first housing 40 in the first open position 52, and the second end 74 may be disposed inside or within the second housing 70 in the second open position 82.) Furthermore, the first contactor assembly 30 may be configured for passing at least 100 volts through its first input contact 32, first end 44, and first output contact 34; similarly, the second contactor assembly 60 may be configured for passing at least 100 volts through its second input contact 62, second end 74, and second output contact 64.

According to another embodiment, an electrical contactor module 22 includes a pair of contactor assemblies 30, 60 each having a respective input contact 32, 62, a respective output contact 34, 64 separated by a respective gap 36, 66 from the respective input contact 32, 62, and a respective linear solenoid 38, 68 disposed proximate the respective input and output contacts 32, 34, 62, 64. Each respective linear solenoid 38, 68 has a respective housing 40, 70, a respective plunger 42, 72 disposed within the respective housing 40, 70 so as to permit axial or longitudinal displacement of the respective plunger 42, 72 between a respective open position 52, 82 (in which a respective end 44, 74 of the respective plunger 42, 72 is spaced apart from the respective input and output contacts 32, 34, 62, 64) and a respective closed position 56, 86 (in which the respective end 44, 74 mechanically contacts and electrically couples the respective input and output contacts 32, 34, 62, 64), a respective spring 48, 78 configured for biasing the respective plunger 42, 72 in the respective open position 52, 82, and a respective coil 50, 80 disposed within the respective housing 40, 70 and configured for urging the respective plunger 42, 72 from the respective open position 52, 82 to the respective closed position 56, 86 along a respective linear direction 54, 84. The electrical contactor module 22 further includes an enclosure 90 in which the contactor assemblies 30, 60 are fastened and arranged, such that the linear directions 54, 84 for the pair of contactor assemblies 30, 60 point in generally opposite directions from each other.

In this embodiment, each respective coil 50, 80 may be further configured for selectably overcoming a respective bias force 95, 96 exerted by the respective spring 48, 78 by a respective electrical activation 59, 89 being applied to the respective coil 50, 80. In a commanded-OFF state 92, the ends 44, 74 of the plungers 42, 72 may be disposed in their respective open positions 52, 82, and in a commanded-ON state 94, the ends 44, 74 of the plungers 42, 72 may be disposed in their respective closed positions 56, 86. In this configuration, the contactor assemblies 30, 60 may be arranged such that if the enclosure 90 is subjected to a mechanical impulse 99 in the commanded-ON state 94 or the commanded-OFF state 92, only one of the ends 44, 74 of the plungers 42, 72 is perturbable by the mechanical impulse 99 from its respective open position 52, 82 or closed position 56, 86. One of the pair of contactor assemblies 30, 60 may be configured for a positive polarity electrical flow 97, and the other of the pair of contactor assemblies 30, 60 may be configured for a negative polarity or ground electrical flow 98, wherein each of the contactor assemblies 30, 60 may be configured for passing at least 100 volts through its respective input contact 32, 62, its respective end 44, 74 of plunger 42, 72, and its respective output contact 34, 64.

According to yet another embodiment, a module 22 for mounting high-voltage contactors 24 includes: (i) a pair of contactor assemblies 30, 60 each having a respective input contact 32, 62, a respective output contact 34, 64 separated by a respective gap 36, 66 from the respective input contact 32, 62, and a respective linear solenoid 38, 68 disposed proximate the respective input and output contacts 32, 34, 62, 64. Each respective linear solenoid 38, 68 has a respective housing 40, 70, a respective plunger 42, 72 disposed within the respective housing 40, 70 so as to permit axial or longitudinal displacement of the respective plunger 42, 72 between a respective open position 52, 82 (in which a respective end 44, 74 of the respective plunger 42, 72 is spaced apart from the respective input contacts 32, 62 and output contacts 34, 64) and a respective closed position 56, 86 (in which the respective end 44, 74 mechanically contacts and electrically couples the respective input contacts 32, 62 and output contacts 34, 64). A respective spring 48, 78 is configured for biasing the respective plunger 42, 72 in the respective open position 52, 82, and a respective coil 50, 80 is disposed within the respective housing 40, 70 and is configured for urging the respective plunger 42, 72 from the respective open position 52, 82 to the respective closed position 56, 86 along a respective linear direction 54, 84. The module 22 also includes an enclosure 90 in which the contactor assemblies 30, 60 are arranged and fastened, such that the respective linear directions 54, 84 for the contactor assemblies 30, 60 point in opposite directions from each other. In a commanded-OFF state 92, the ends 44, 74 of the plungers 42, 72 are disposed in their respective open positions 52, 82, and in a commanded-ON state 94, the ends 44, 74 of the plungers 42, 72 are disposed in their respective closed positions 56, 86. The first and second contactor assemblies 30, 60 are arranged such that if a mechanical impulse 99 is imparted onto the enclosure 90 in the commanded-ON state 94 or the commanded-OFF state 92, only one of the first and second ends 44, 74 is perturbable by the mechanical impulse 99 from its respective open position 52, 82 or its respective closed position 56, 86.

Each respective coil 50, 80 in this embodiment may be further configured for selectably overcoming a respective bias force 95, 96 exerted by the respective spring 48, 78 by a respective electrical activation 59, 89 being applied to the respective coil 50, 80. Additionally, each respective end 44, 74 may extend or lie outside its respective housing 40, 70 in the commanded-OFF state 92. A first one of the pair of contactor assemblies 30, 60 may be configured for a positive polarity electrical flow 97, and a second one of the pair of contactor assemblies 30, 60 may be configured for a negative polarity or ground electrical flow 98. Moreover, each of the contactor assemblies 30, 60 may be configured for passing at least 100 volts through its respective input contact 32, 62, its respective plunger end 44, 74, and its respective output contact 34, 64.

Figure 10:
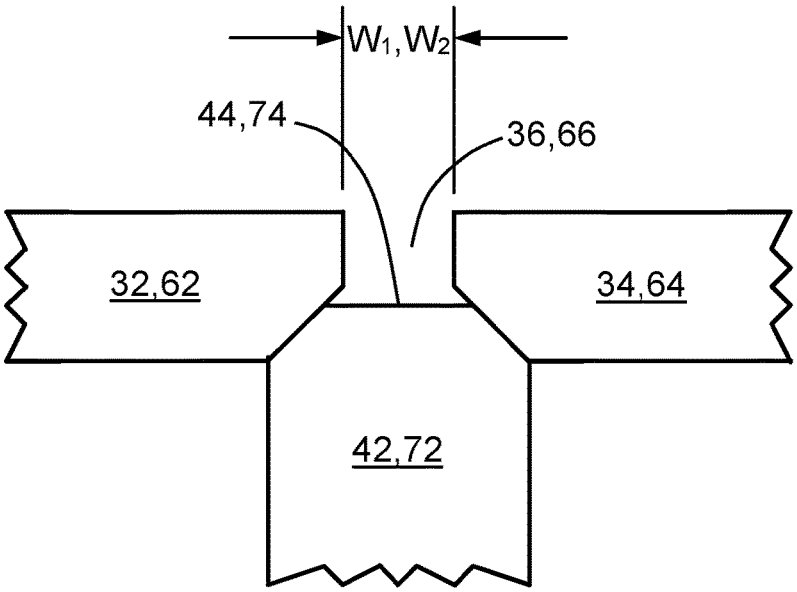
FIG. 10 is a schematic close-up view of one embodiment of the contacts and plunger of an electrical contactor module in a commanded-ON state.

FIG. 10 shows a schematic close-up view of an embodiment of the contacts 32, 34, 62, 64 and plunger 42, 72 of an electrical contactor module 22 in a commanded-ON state 94. Here, the end 44, 74 of the plunger 42, 72 and the contacts 32, 34, 62, 64 are shaped and configured such that the contact surfaces between the end 44, 74 and the contacts 32, 34, 62, 64 are disposed at an angle (e.g., 45 degrees) with respect to the longitudinal axis of the plunger 42, 72.

It can be seen from the various embodiments disclosed herein that with the electrical contactor assemblies 30, 60 being arranged with their linear actuation directions 54, 84 pointing in generally opposite directions from each other, inadvertent closure of both of the first and second electrical flows 97, 98 at the same time may be prevented, even in the event of an external mechanical impulse 99 acting on the module 22 or enclosure 90.

The above description is intended to be illustrative, and not restrictive. While the dimensions and types of materials described herein are intended to be illustrative, they are by no means limiting and are exemplary embodiments. In the following claims, use of the terms "first", "second", "top", "bottom", etc. are used merely as labels, and are not intended to impose numerical or positional requirements on their objects. As used herein, an element or step recited in the singular and preceded by the word "a" or "an" should be understood as not excluding plural of such elements or steps, unless such exclusion is explicitly stated. Additionally, the phrase "at least one of A and B" and the phrase "A and/or B" should each be understood to mean "only A, only B, or both A and B". Moreover, unless explicitly stated to the contrary, embodiments "comprising" or "having" an element or a plurality of elements having a particular property may include additional such elements not having that property. And when broadly descriptive adverbs such as "substantially" and "generally" are used herein to modify an adjective, these adverbs mean "for the most part", "to a significant extent" and/or "to a large degree", and do not necessarily mean "perfectly", "completely", "strictly" or "entirely". Additionally, the word "proximate" may be used herein to describe the location of an object or portion thereof with respect to another object or portion thereof, and/or to describe the positional relationship of two objects or their respective portions thereof with respect to each other, and may mean "near", "adjacent", "close to", "close by", "at" or the like.

This written description uses examples, including the best mode, to enable those skilled in the art to make and use devices, systems and compositions of matter, and to perform methods, according to this disclosure. It is the following claims, including equivalents, which define the scope of the present disclosure.

What is claimed is:

1. An arrangement of electrical contactor assemblies, comprising:

a first contactor assembly having a first input contact, a first output contact spaced a first width from the first input contact, and a first linear solenoid disposed proximate the first input and output contacts, the first linear solenoid having a first housing, a first plunger disposed within the first housing so as to permit axial displacement of the first plunger between a first open position in which a first end of the first plunger is spaced apart from the first input and output contacts and a first closed position in which the first end mechanically contacts and electrically couples the first input and output contacts, a first spring configured for biasing the first plunger in the first open position, and a first coil disposed within the first housing and configured for urging the first plunger from the first open position to the first closed position along a first linear direction;

a second contactor assembly having a second input contact, a second output contact spaced a second width from the second input contact, and a second linear solenoid disposed proximate the second input and output contacts, the second linear solenoid having a second housing, a second plunger disposed within the second housing so as to permit axial displacement of the second plunger between a second open position in which a second end of the second plunger is spaced apart from the second input and output contacts and a second closed position in which the second end mechanically contacts and electrically couples the second input and output contacts, a second spring configured for biasing the second plunger in the second open position, and a second coil disposed within the second housing and configured for urging the second plunger from the second open position to the second closed position along a second linear direction that is generally opposite the first linear direction; and an enclosure in which the first and second contactor assemblies are fastened and arranged.

2. The arrangement of claim 1, wherein the first coil is further configured for selectably overcoming a first bias force exerted by the first spring, and the second coil is further configured for selectably overcoming a second bias force exerted by the second spring.

3. The arrangement of claim 2, wherein the first coil is further configured for selectably overcoming the first bias force by a first electrical activation being applied to the first coil, and the second coil is further configured for selectably overcoming the second bias force by a second electrical activation being applied to the second coil.

4. The arrangement of claim 1, wherein the first and second ends of the first and second plungers, respectively, are electrically conductive.

5. The arrangement of claim 1, wherein the first input and output contacts are separated by a first gap, and the second input and output contacts are separated by a second gap.

6. The arrangement of claim 1, wherein in a commanded-OFF state, the first and second ends are disposed in the first and second open positions, respectively, and in a commanded-ON state, the first and second ends are disposed in the first and second closed positions, respectively.

7. The arrangement of claim 6, wherein the first and second contactor assemblies are arranged such that if the enclosure is subjected to a mechanical impulse in the commanded-ON or commanded-OFF state, only one of the first and second ends is perturbable by the mechanical impulse from its respective open or closed position.

8. The arrangement of claim 1, wherein the first contactor assembly is configured for a positive polarity electrical flow, and the second contactor assembly is configured for a negative polarity electrical flow.

9. The arrangement of claim 1, wherein the first end extends outside the first housing in the first open position, and the second end extends outside the second housing in the second open position.

10. The arrangement of claim 1, wherein each of the first and second contactor assemblies is configured for passing at least 100 volts through its respective input contact, end and output contact.

11. An electrical contactor module, comprising:

a pair of contactor assemblies each having a respective input contact, a respective output contact separated by a respective gap from the respective input contact, and a respective linear solenoid disposed proximate the respective input and output contacts, each respective linear solenoid having a respective housing, a respective plunger disposed within the respective housing so as to permit axial displacement of the respective plunger between a respective open position in which a respective end of the respective plunger is spaced apart from the respective input and output contacts and a respective closed position in which the respective end mechanically contacts and electrically couples the respective input and output contacts, a respective spring configured for biasing the respective plunger in the respective open position, and a respective coil disposed within the respective housing and configured for urging the respective plunger from the respective open position to the respective closed position along a respective linear direction; and an enclosure in which the contactor assemblies are fastened and arranged, such that the linear directions for the pair of contactor assemblies point in generally opposite directions from each other.

12. The electrical contactor module of claim 11, wherein each respective coil is further configured for selectably overcoming a respective bias force exerted by the respective spring by a respective electrical activation being applied to the respective coil.

13. The electrical contactor module of claim 11, wherein in a commanded-OFF state, the ends of the plungers are disposed in their respective open positions, and in a commanded-ON state, the ends of the plungers are disposed in their respective closed positions.

14. The electrical contactor module of claim 13, wherein the contactor assemblies are arranged such that if the enclosure is subjected to a mechanical impulse in the commanded-ON or commanded-OFF state, only one of the ends of the plungers is perturbable by the mechanical impulse from its respective open or closed position.

15. The electrical contactor module of claim 11, wherein one of the pair of contactor assemblies is configured for a positive polarity electrical flow, and the other of the pair of contactor assemblies is configured for a negative polarity electrical flow, wherein each of the contactor assemblies is configured for passing at least 100 volts through its respective input contact, end of plunger and output contact.

16. A module for mounting high-voltage contactors, comprising:

a pair of contactor assemblies each having a respective input contact, a respective output contact separated by a respective gap from the respective input contact, and a respective linear solenoid disposed proximate the respective input and output contacts, each respective linear solenoid having a respective housing, a respective plunger disposed within the respective housing so as to permit axial displacement of the respective plunger between a respective open position in which a respective end of the respective plunger is spaced apart from the respective input and output contacts and a respective closed position in which the respective end mechanically contacts and electrically couples the respective input and output contacts, a respective spring configured for biasing the respective plunger in the respective open position, and a respective coil disposed within the respective housing and configured for urging the respective plunger from the respective open position to the respective closed position along a respective linear direction; and an enclosure in which the contactor assemblies are arranged and fastened, such that the linear directions for the pair of contactor assemblies point in opposite directions from each other;

wherein in a commanded-OFF state, the ends of the plungers are disposed in their respective open positions, and in a commanded-ON state, the ends of the plungers are disposed in their respective closed positions, the first and second contactor assemblies being arranged such that if a mechanical impulse is imparted onto the enclosure in the commanded-ON or commanded-OFF state, only one of the first and second ends is perturbable by the mechanical impulse from its respective open or closed position.

17. The module of claim 16, wherein each respective coil is further configured for selectably overcoming a respective bias force exerted by the respective spring by a respective electrical activation being applied to the respective coil.

18. The module of claim 16, wherein each respective end extends outside its respective housing in the commanded-OFF state.

19. The module of claim 16, wherein a first one of the pair of contactor assemblies is configured for a positive polarity electrical flow, and a second one of the pair of contactor assemblies is configured for a negative polarity electrical flow.

20. The module of claim 16, wherein each of the contactor assemblies is configured for passing at least 100 volts through its respective input contact, end of plunger and output contact.

* * * * *